US010144221B2

(12) United States Patent
Nakanishi et al.

(10) Patent No.: US 10,144,221 B2
(45) Date of Patent: Dec. 4, 2018

(54) PRINTING APPARATUS AND METHOD FOR DETERMINING SERVICE LIFE

(71) Applicant: CANON FINETECH INC., Misato-shi, Saitama (JP)

(72) Inventors: Yuta Nakanishi, Bando (JP); Kazuki Sakamoto, Kawasaki (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 15/494,842

(22) Filed: Apr. 24, 2017

(65) Prior Publication Data

US 2017/0313087 A1 Nov. 2, 2017

(30) Foreign Application Priority Data

Apr. 28, 2016 (JP) ..... 2016-092091

(51) Int. Cl.
*B41J 2/165* (2006.01)

(52) U.S. Cl.
CPC ..... *B41J 2/16538* (2013.01)

(58) Field of Classification Search
CPC ..... B41J 2/16538; B41J 2/16535; B41J 2/16558; B41J 2/16541
See application file for complete search history.

(56) References Cited

U.S. PATENT DOCUMENTS

| | | | | |
|---|---|---|---|---|
| 5,966,157 | A * | 10/1999 | Dolan | B41J 2/005 101/91 |
| 7,503,638 | B2 | 3/2009 | Sato et al. | |
| 9,039,133 | B2 | 5/2015 | Nakanishi | |
| 9,162,463 | B2 | 10/2015 | Ito | |
| 2004/0061737 | A1* | 4/2004 | Yamazaki | B41J 2/16535 347/33 |
| 2006/0066665 | A1 | 3/2006 | Kachi et al. | |
| 2008/0316253 | A1* | 12/2008 | Inuoe | B41J 2/16585 347/33 |

FOREIGN PATENT DOCUMENTS

| | | | |
|---|---|---|---|
| JP | H08-072256 | A | 3/1996 |
| JP | H10-100426 | A | 4/1998 |
| JP | 2004-130595 | A | 4/2004 |
| JP | 2004-237462 | A | 8/2004 |
| JP | 2005-349782 | A | 12/2005 |
| JP | 2006-095704 | A | 4/2006 |
| JP | 2006-095881 | A | 4/2006 |
| JP | 2006-240174 | A | 9/2006 |
| JP | 2009-023358 | A | 2/2009 |
| JP | 2011-025621 | A | 2/2011 |
| JP | 2013-180401 | A | 9/2013 |
| JP | 2014-226808 | A | 12/2014 |

* cited by examiner

*Primary Examiner* — Jason Uhlenhake
(74) *Attorney, Agent, or Firm* — Fitzpatrick, Cella, Harper & Scinto

(57) ABSTRACT

To provide a printing apparatus and a method for determining a service life of a cleaning mechanism, capable of more accurately determining a service life of a cleaning mechanism. For the purpose, a service life of a recovery unit is determined by multiplication of a number of times a blade wipes a face surface by a coefficient different depending on a quantity of liquid adhering to the face surface.

12 Claims, 17 Drawing Sheets

| PRECEDING OPERATION | WEIGHTING COEFFICIENT |
|---|---|
| WIPE OPERATION | 0.1 |
| INK EJECTION OPERATION | 1.0 |
| NOZZLE SUCTION OPERATION | 1.2 |
| NOZZLE PRESSURIZATION OPERATION | 1.5 |
| CAPPING OPERATION | 0.2 |

FIG.7

| ELAPSED TIME (h) | BLADE CLEANER SERVICE LIFE COEFFICIENT |
|---|---|
| 0~2 | 1.2 |
| 3~7 | 1.1 |
| 8~17 | 1.0 |
| 18~24 | 0.9 |

FIG.8

| PRECEDING OPERATION | OUTLINE OF OPERATIONS | WEIGHTING COEFFICIENT |
|---|---|---|
| CLEANING STRONG | ABS+PRG+WIP+CAP | 2.5 |
| CLEANING WEAK | PRG+WIP+CAP | 1.3 |
| CLEANING A | PRG+WIP+WIP+CAP | 1.4 |
| CLEANING B | ABS+WIP+CAP | 1.5 |
| CLEANING C | PRS+ABS+PRG+WIP+CAP | 4.0 |

WIP:WIPING OPERATION (0.1)
PRG:INK EJECTION OPERATION (1.0)
ABS:NOZZLE SUCTION OPERATION (1.2)
PRS:NOZZLE PRESSURIZATION OPERATION (1.5)
CAP:CAPPING OPERATION (0.2)

FIG.10

| PRECEDING OPERATION | WEIGHTING COEFFICIENT |
|---|---|
| INK EJECTION OPERATION | 1.0 |
| NOZZLE SUCTION OPERATION | 0.7 |
| NOZZLE PRESSURIZATION OPERATION | 0.7 |
| WIPING OPERATION | 1.2 |

FIG.13

| ELAPSED TIME (h) | BLADE SERVICE LIFE COEFFICIENT |
|---|---|
| 0~2 | 0.7 |
| 3~7 | 0.8 |
| 8~17 | 0.9 |
| 18~24 | 1.0 |

FIG.14

| NUMBER OF TIMES OF WIPING IN RECOVERY SEQUENCE | WEIGHTING COEFFICIENT |
|---|---|
| FIRST | 1.0 |
| SECOND | 1.2 |
| THIRD | 0.7 |
| FOURTH | 0.7 |

FIG.16

PRINTING APPARATUS AND METHOD FOR DETERMINING SERVICE LIFE

BACKGROUND OF THE INVENTION

Field of the Invention

The present invention relates to a printing apparatus including a cleaning mechanism cleaning an ejection port surface including a plurality of ejection ports that ejects liquid, and to a method for determining a service life of the cleaning mechanism.

Description of the Related Art

There is known a so-called inkjet printing apparatus that performs printing by ejecting ink from a plurality of nozzles provided at a print head. Generally, an inkjet printing apparatus includes a cleaning mechanism that performs a cleaning operation for stabilizing printing quality. The cleaning mechanism includes a cap that covers a face surface on which nozzles of the print head are opened, a blade that wipes the face surface, a blade cleaner that cleans the blade, and the like.

The cleaning mechanism performs a nozzle suction operation that covers the face surface with a cap and performs suction from a nozzle, and a purge operation that ejects ink for printing in the cap, thereby stabilizing a recording quality. In addition, after these operations, the ink may adhere to the face surface of the print head and cause printing failure, and thus a wiping operation that wipes the ink by moving the blade is executed.

A blade to be used in the wiping operation has a problem that remaining ink adhering to the blade by wiping are firmly fixed by the evaporation and the wiping performance is deteriorated.

In Japanese Patent Laid-Open No. 2006-95704, there is disclosed a method for keeping a blade in a good condition and for suppressing the degradation of wiping performance by bringing a blade into contact with a blade cleaner after a wiping operation and by making the blade cleaner absorb the wiped ink.

The blade cleaner that cleans the blade absorbs the ink wiped by the blade every time the wiping operation is performed. As wiping is repeated, the absorbed ink increases in the blade cleaner and the absorption cannot be performed any more, that is the end of the service life of the blade cleaner. In a case where the wiping is continued even after reaching the end of the service life of the blade cleaner, sufficient cleaning of the blade cannot be performed, and a state in which the ink remains on the blade is reached, deteriorating the wiping performance due to firm fixing of the ink.

In Japanese Patent Laid-Open No. 2006-95704, the blade cleaner absorbs the ink on the blade, but exchange timing of the blade cleaner is not mentioned. Therefore, the exchange timing of the blade cleaner cannot be grasped, and wiping performance may be deteriorated.

SUMMARY OF THE INVENTION

The printing apparatus of the present invention has: an ejection unit configured to eject liquid from an ejection port; a recovery unit including a blade that wipes an ejection port surface provided with the ejection port and a cleaner that performs cleaning of the blade by abutting on the blade; and a determination unit configured to determine a service life of the recovery unit based on a quantity of liquid adhering to the ejection port surface in a case where the blade wipes the ejection port surface.

Further features of the present invention will become apparent from the following description of exemplary embodiments with reference to the attached drawings.

BRIEF DESCRIPTION OF THE DRAWINGS

FIG. 7 is a table showing coefficients for each operation performed just before the wiping operation;

FIG. 8 is a table showing coefficients for each elapsed time from an operation performed just before the wiping operation;

FIG. 10 is a table showing breakdowns of operations in a cleaning operation and corresponding coefficients;

FIG. 13 is a table showing coefficients for each operation performed just before the wiping operation;

FIG. 14 is a table showing coefficients for each elapsed time from an operation just before the wiping;

FIG. 16 is a table showing an example of coefficients for consumption degrees for each number of times of wiping.

DESCRIPTION OF THE EMBODIMENTS

First Embodiment

Hereinafter, a first embodiment of the present invention will be described with reference to the drawings. Note that the "printing" in the specification represents not only cases where significant information such as character or figure is formed, but also, widely, cases of forming image, design, pattern, or the like on a printing medium or cases of performing processing of a medium, irrespective of whether or not the information is significant, or irrespective of whether or not the information is actualized so as to be able to be visually perceived by a person. Furthermore, the "printing medium" (also referred to as sheet) represents not only paper to be used in a general printing apparatus, but also, widely, materials that can receive ink such as cloth, plastic film, metal plate, glass, ceramics, wood and leather. Furthermore, the "ink" is to be widely construed in a similar way as in the definition of the "printing," and represents a liquid that may be subjected to formation of an image, design, pattern, or the like, processing of the printing medium, or a treatment of the ink (solidification or insolubilization of a color material in the ink), by being imparted onto the printing medium.

Figure 1:
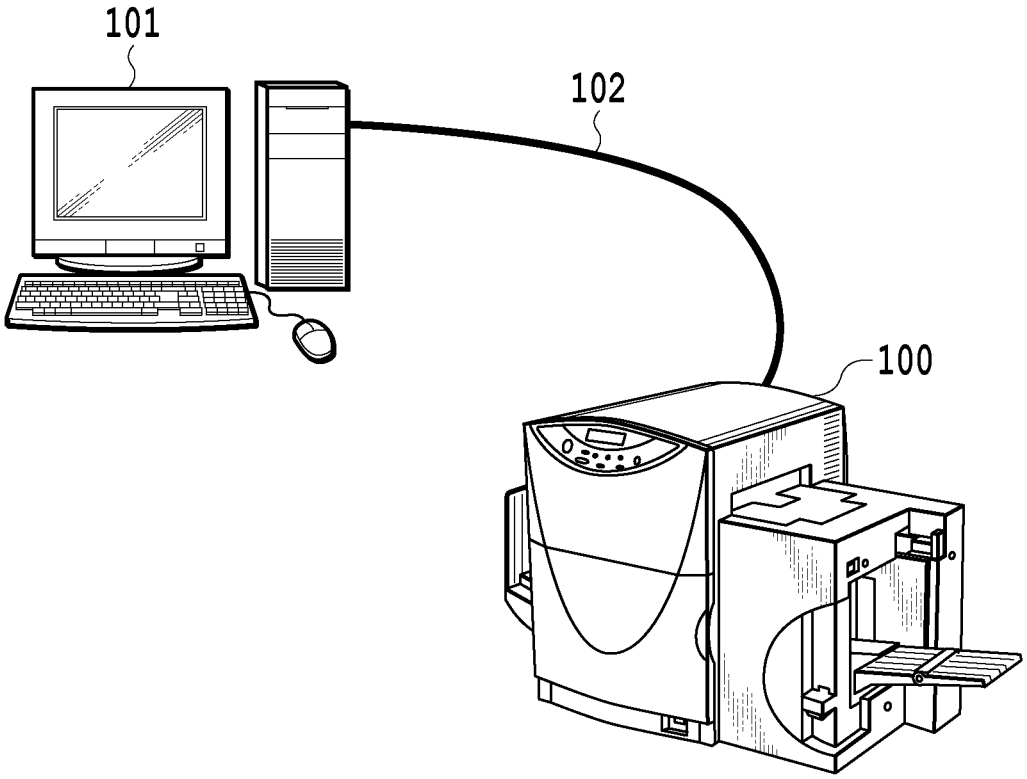
FIG. 1 is a diagram showing a printing system.

FIG. 1 is a diagram showing a printing system using a printing apparatus to which the present embodiment is applicable. A color printing apparatus (hereinafter, also referred to as a printing apparatus) 100 using a full-line print head of an inkjet system and a host computer 101 (hereinafter, also referred to as a host) are connected each other with a printer cable 102. Various data having been processed by the host 101 are sent to the printing apparatus 100 via the printer cable 102, and are printed by the printing apparatus 100.

Figure 2:
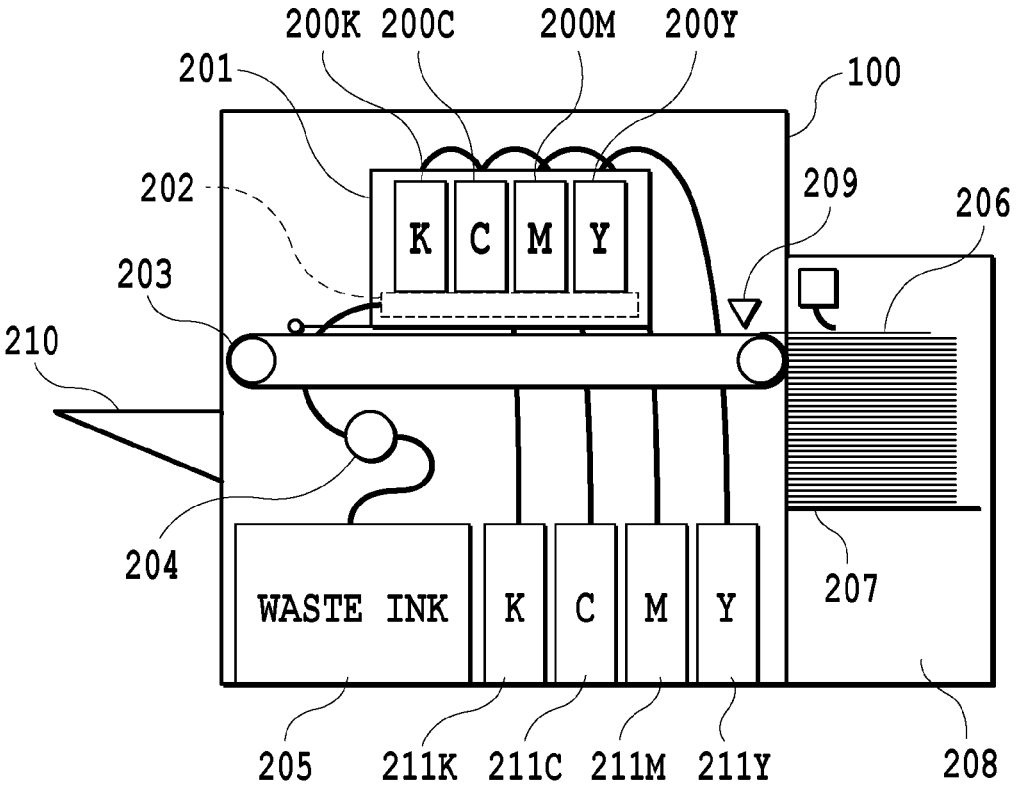
FIG. 2 is a diagram showing a main part of a printing apparatus.

FIG. 2 is a diagram showing a main part of the printing apparatus 100 to which the present embodiment is applicable. The printing apparatus 100 is provided with a head unit 201 including a print head 200K for black, a print head 200C for cyan, a print head 200M for magenta, and a print head 200Y for yellow, in which a plurality of ejection ports (hereinafter, also referred to as a nozzle) is arranged over the whole width of a printing medium. Furthermore, the printing apparatus 100 is provided with a recovery unit 202 being a cleaning mechanism that satisfactorily maintains an ejection state of the print head 200, a conveying unit 203 conveying a printing medium, a pressure pump 204 used for suction cleaning, and a waste ink tank 205 storing a waste ink. It is possible for the printing apparatus 100 to perform full-color printing for a printing medium, by providing these. A sheet feed unit 208, in which a plurality of cut sheets 206 is loaded on a sheet feed tray 207, is mounted on the upstream of the conveying unit 203, and the cut sheet 206 being a printing medium is fed to the conveying unit 203 from the sheet feed unit 208. A sensor (hereinafter, also referred to as a TOF sensor) 209 detecting a space between pages of a plurality of printing media loaded on the conveying unit 203 detects the front edge of the printing medium, and printing is performed sequentially on the conveyed printing medium by using each of print heads, with the detection result as a trigger. The cut sheet 206 to which the printing has been completed is conveyed to a discharge port 213, and is stacked on a discharge tray 210.

Inks used for printing are supplied to each print head of a corresponding color by using the pressure pump 204 from an ink tank 211K for black, an ink tank 211C for cyan, an ink tank 211M for magenta, and an ink tank 211Y for yellow which are attachable to and detachable from the main body of the printing apparatus 100. Furthermore, ink sucked from a nozzle of the print head for maintaining reliability of an image, or ink ejected by so-called preliminary ejection in which ink not contributing to printing is ejected, is moved from the recovery unit 202 to the waste ink tank 205 with the pressure pump 204 and is discarded.

Figure 3:
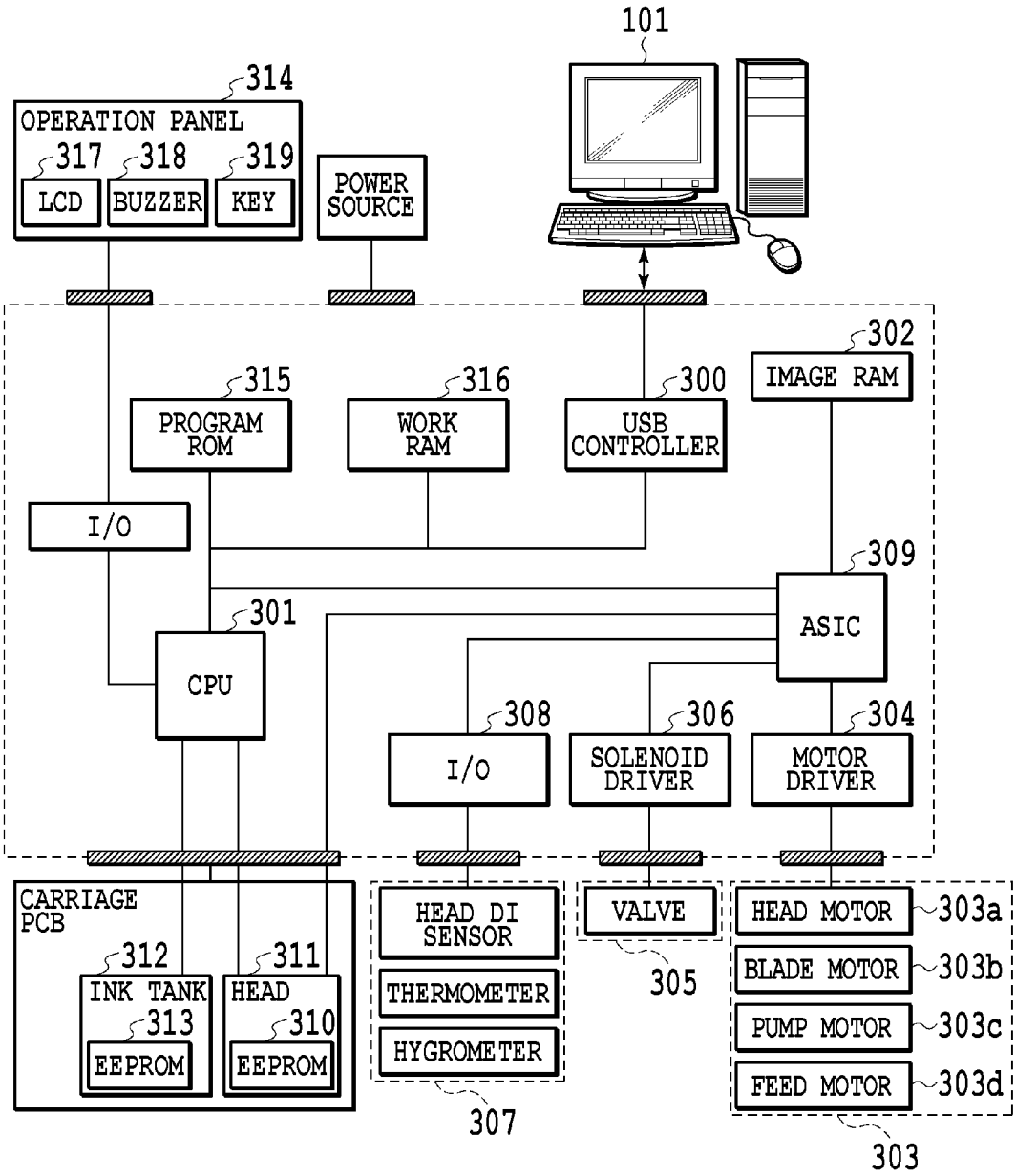
FIG. 3 is a control system block diagram of the printing apparatus.

FIG. 3 is a block diagram of a control system of the printing apparatus 100. The printing apparatus 100 is provided with a USB interface controller 300 that receives printing data or command from the host 101, and a CPU 301 being an arithmetic processing unit managing overall control in the printing apparatus, such as reception of printing data and printing operation. The CPU 301 reads sequentially printing data of corresponding color from an image RAM 302 in synchronization with the detection of the printing medium, and transfers the read data to each of print heads 310. In addition, the CPU performs respective control by executing a processing program stored in a program ROM 315. Additionally, the printing apparatus 100 is provided with the image RAM 302 that executes image data expansion of printing data, a motor driver 304 that drives various motors 303 (head motor, blade motor, pump motor, and conveying motor), and a solenoid driver 306 that controls a valve 305. Furthermore, the printing apparatus 100 is provided with an I/O 308 for inputting various sensors 307 (head diode sensor, thermometer, hygrometer), an ASIC 309 that controls the whole printing apparatus, and a print head 310 that prints, on the printing medium, an image expanded in the image RAM 302. Moreover, the printing apparatus 100 is provided with a head EEPROM 311 that is mounted for each print head and holds inherent data, an ink tank 312 that supplies ink to the print head 310, and an ink tank EEPROM 313 that is mounted for each ink tank and holds inherent data. The printing apparatus 100 is controlled by the operation of an operation panel 314 that accepts input from the outside by a user.

The program ROM 315 stores a processing program, a table, and the like which correspond to a control flow. In addition, a work RAM 316 is used as a memory for work. In the cleaning operation of each of the print heads 310, the CPU 301 drives various motors 303 while monitoring various sensors 307 via the motor driver 304, and performs control such as pressurization or suction of ink. Inks used for recording or cleaning are supplied from each of ink tanks 312. The ink tank EEPROM 313 is mounted in each of ink tanks 312, in which IDs and serial numbers indicating colors or kinds of inks are written, and in addition, a use quantity counter for detecting a remaining quantity can be held. The operation panel 314 is used as an interface between the printing apparatus and a user. The operation panel 314 is provided with an LCD 317 and a buzzer 318 for informing a user of a state from the printer, and a key 319 for performing instructions from a user to the printer.

Figure 4:
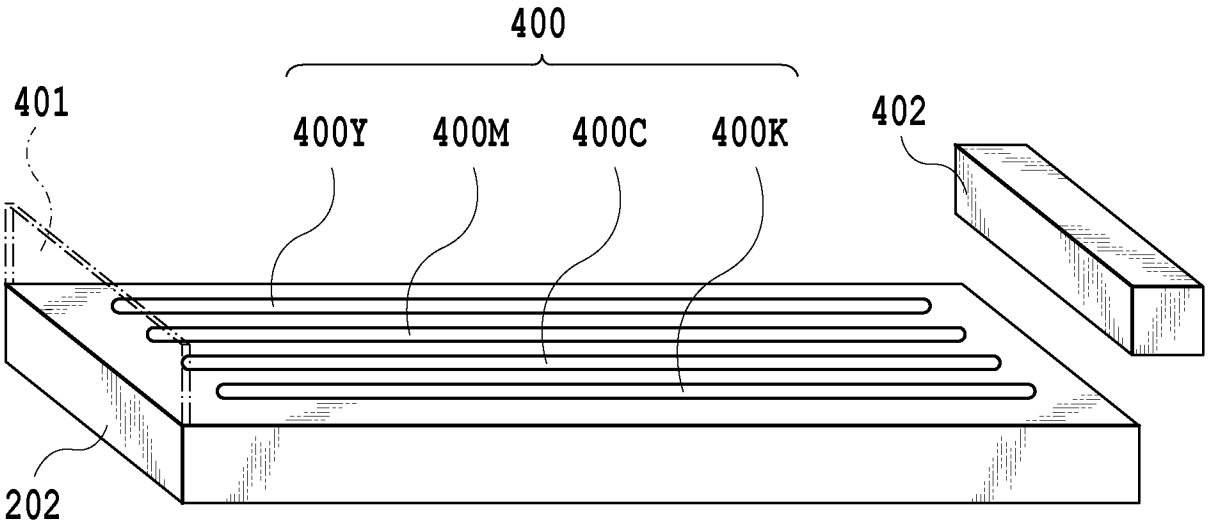
FIG. 4 is a configuration diagram showing details of a recovery unit of the printing apparatus.

FIG. 4 shows a configuration diagram showing the detail of the recovery unit 202 of the printing apparatus 100. The recovery unit 202 is provided with a cap part 400 that receives the ink ejected from the print head 200 for the purpose of cleaning, and a blade 401 for wiping out the adhering to the face surface of the print head 200. Furthermore, the recovery unit 202 is provided with a blade cleaner 402 for collecting the ink wiped by the blade 401.

Figure 5A:
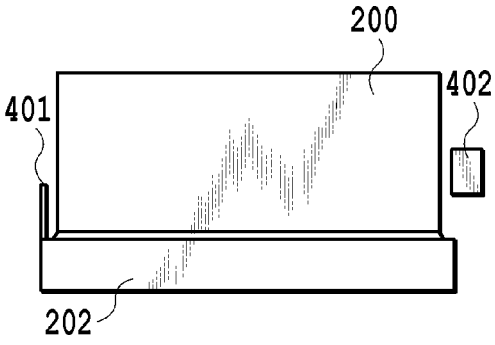
FIG. 5A is a diagram showing a wiping operation in the printing apparatus.
Figure 5B:
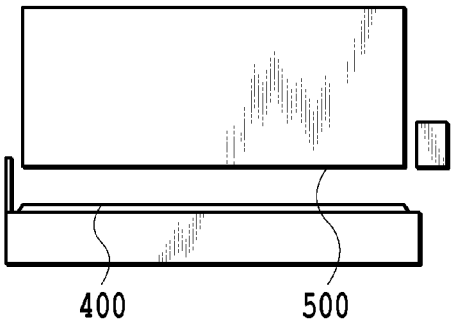
FIG. 5B is a diagram showing a wiping operation in the printing apparatus.
Figure 5C:
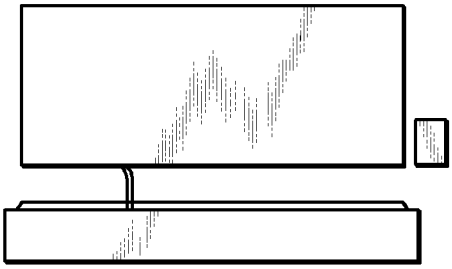
FIG. 5C is a diagram showing a wiping operation in the printing apparatus.
Figure 5D:
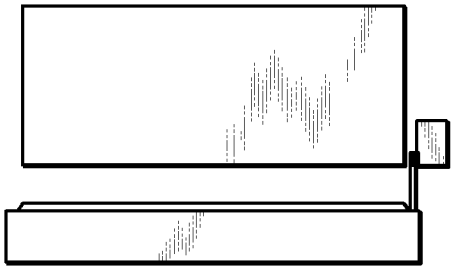
FIG. 5D is a diagram showing a wiping operation in the printing apparatus.

FIGS. 5A to 5D are diagrams showing a flow of a wiping operation in the printing apparatus 100. In a case where the printing apparatus 100 is not in print operation, a face surface 500 of the print head 200 is covered with the recovery unit 202 as shown in FIG. 5A in order to protect the face surface 500. In performing the wiping operation, as shown in FIG. 5B, the CPU 301 drives the head motor 303*a* to move the print head 200 to the wiping position. After the print head 200 has moved to the wiping position, the blade 401 moves along the print head face surface 500 by a blade motor 303*b* as shown in FIG. 5C, and thus wipes the ink adhering to the face surface 500 of the print head 200. The ink that is wiped and adheres to the blade 401 is collected by the blade cleaner 402, by abutment of the blade 401 onto the blade cleaner 402 as shown in FIG. 5D. The print head 200 and the blade 401 are maintained in satisfactory conditions on the basis of the wiping operation.

Figure 6A:
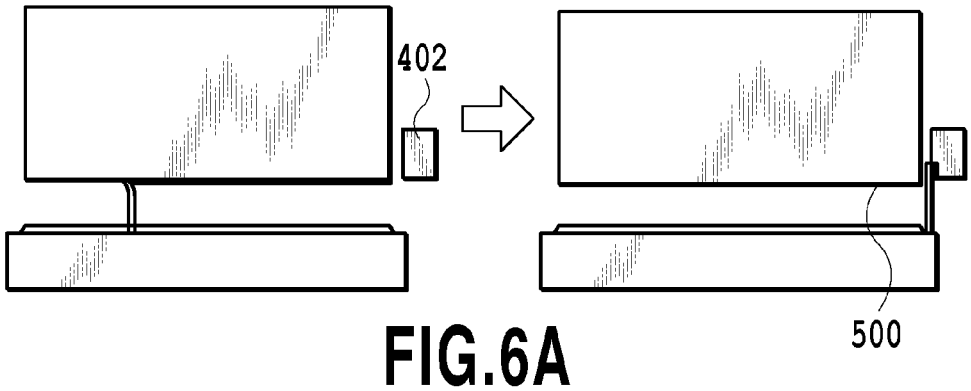
FIG. 6A is a diagram showing a wiping operation in a case where an ink quantity to be collected is different.
Figure 6B:
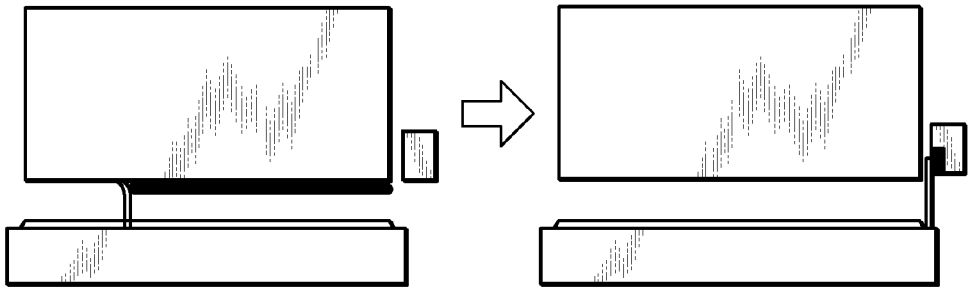
FIG. 6B is a diagram showing a wiping operation in a case where an ink quantity to be collected is different.

FIGS. 6A and 6B are diagrams showing wiping operations in a case where quantities of inks to be collected are different. FIG. 6A shows a case where a quantity of the ink adhering to the face surface 500 by an operation performed just before the wiping operation is small. In a case where the blade cleaner 402 has collected a predetermined quantity of the ink, the cleaner cannot collect an ink any more, which unit that the end of the service life of the blade cleaner 402 is reached. Even if a wiping operation is performed in a state in FIG. 6A, the ink quantity collected by the blade cleaner 402 is small, and thus an influence on the service life of the blade cleaner is small. FIG. 6B shows a case where a quantity of the ink adhering to the face surface 500 is large by an operation performed just before the wiping operation. In a case where a wiping operation is performed in this state, the ink quantity collected by the blade cleaner 402 is large, and thus an influence on the service life of the blade cleaner is large.

As described above, the influence on the service life of the blade cleaner 402 varies depending on amount of the ink adhering to the face surface 500, and amount of the ink adhering to the face surface 500 varies depending on the operation performed immediately before. Therefore, even if only a number of times of wiping operations is counted, an accurate service life of the blade cleaner 402 cannot be grasped. Accordingly, in the present embodiment, coefficients are set for each operation performed just before the wiping operation, and there is performed weighting to a counted value of the wiping operation for determining the service life of the blade cleaner 402.

Furthermore, the influence on the service life of the blade cleaner 402 varies also depending on elapsed times after the completion of an operation performed just before a wiping operation. Namely, in a case where the elapsed time from the completion of an operation performed just before a wiping operation is short, the volatilization amount of a solvent component from the ink adhering to the face surface 500 is small, and thus the ink is easily collected by the blade 401, giving a large influence on the service life of the blade cleaner. However, in a case where the elapsed time from the completion of an operation performed just before the wiping operation is long, volatilization of a solvent component from the ink adhering to the face surface 500 proceeds and causes high viscosity, and thus collection by the blade 401 becomes difficult and an influence on the service life of the blade cleaner is small.

Consequently, in the present embodiment, in addition to coefficients for each operation performed just before the wiping operation, coefficients are provided at every elapsed time from the completion of an operation performed just before the wiping operation, and weighting is performed to the count value of the wiping operation. Accordingly, the service life of the recovery unit 202 is determined.

FIG. 7 is a table showing coefficients for each operation performed just before a wiping operation in the present embodiment. A case where the preceding operation being an ink ejection operation is set as a standard (1.0), and after a nozzle suction operation and a nozzle pressurization operation in which a quantity of the ink adhering to the face surface 500 is estimated to be large, the coefficient is set large and weighting to the service life counter of the blade cleaner 402 is performed. In contrast, after the wiping operation or capping operation in which a quantity of the ink adhering to the face surface 500 is estimated to be small, the coefficient is set small and weighting to the service life counter of the blade cleaner 402 is performed.

Furthermore, the weighting to the service life counter of the blade cleaner 402 may be changed depending on an execution interval between wiping operations.

FIG. 8 is a table showing coefficients for each elapsed time from an operation performed just before a wiping operation in the present embodiment. The longer an elapsed time from a wiping operation to the subsequent wiping operation becomes, the more moisture in the ink absorbed by the blade cleaner 402 evaporates and the smaller the volume occupying in the blade cleaner becomes. Accordingly, in a case where the subsequent wiping operation is performed, weighting is performed to the service life counter of the blade cleaner 402 by the use of the coefficient based on the elapsed time.

Figure 9:
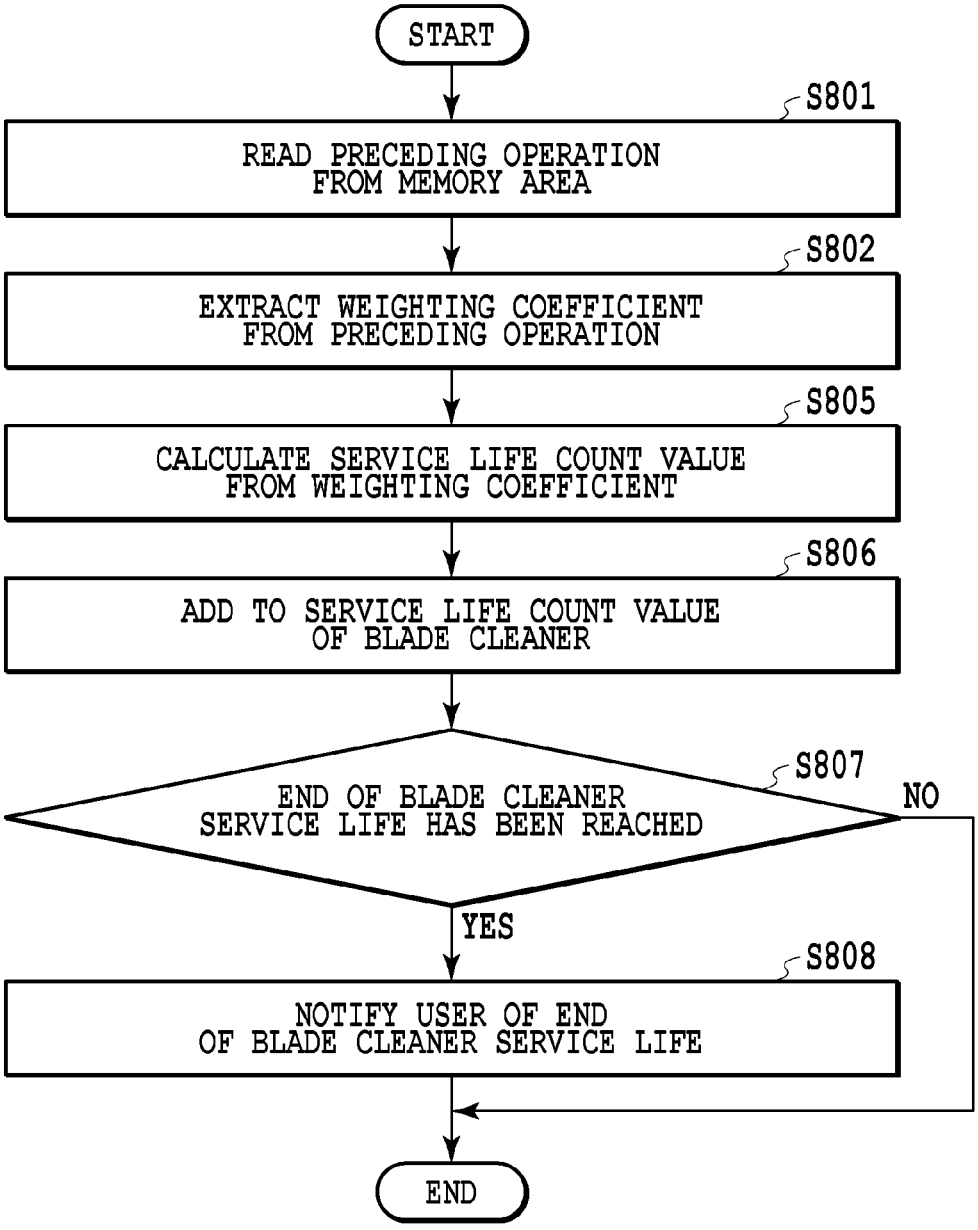
FIG. 9 is a flow chart showing processing in the wiping operation of the printing apparatus.

FIG. 9 is a flow chart showing processing in the wiping operation of the printing apparatus 100 of the present embodiment. Hereinafter, the wiping operation in the present embodiment will be described by the use of the flow chart. In a case where recovery unit 202 starts a wiping operation, CPU 301 reads the preceding operation stored in the RAM 316 in Step S801. Then, in Step S802, CPU 301 extracts the weighting coefficient corresponding to the preceding operation read in Step S801 from ROM 315. In Step S805, CPU 301 calculates a count value to be added to a service life count value. In the present embodiment, it is defined as follows:

(count value to be added)=(number of times of wiping per one wiping operation)×(weighting coefficient for the preceding operation)

Such calculation of the count value is performed for each wiping operation.

After that, in Step S806, CPU 301 adds the count value of this time based on the calculation result in Step S805 to the service life count value of the blade cleaner 402 stored in the RAM 316. Then, in Step S807, CPU 301 compares the addition result with a service life count threshold value of the blade cleaner 402, and, in a case where the addition result is within the service life count threshold value of the blade cleaner 402, the processing is completed. In a case where the addition result exceeds the service life count threshold value of the blade cleaner 402, the processing proceeds to Step S808. CPU 301 notifies this fact to the user by error generation or the like. Then CPU 301 prompts the user to exchange the blade cleaner 402, and thus the processing is completed.

As described above, the service life of the recovery unit is determined by multiplication of a number of times the blade wipes the face surface by a coefficient that is different depending on the quantity of a liquid adhering to the face surface. Accordingly, it has become possible to realize a printing apparatus and a method for determining cleaning mechanism service life, capable of more accurately determining the service life of the cleaning mechanism.

Note that, in the present embodiment, in a case where the end of the service life of the blade cleaner 402 is determined to have been reached, the user is notified of the end of the service life to be prompted to exchange the blade cleaner 402, but the embodiment is not limited thereto. Namely, in a case where it is determined that the end of the service life of the blade cleaner 402 has been reached, an operation of the apparatus may be changed depending on the determination result. For example, in a case where it is determined that the service life of the blade cleaner 402 has been reached, after that, wiping without abutting on the blade cleaner may be performed with a limited number of times. Alternatively, the processing may proceed to an operation of removing the ink from the blade cleaner by provision of a mechanism for removing the ink sucked by the blade cleaner.

Furthermore, in the present embodiment, the service life is determined in consideration of only weighting corresponding to the preceding operation, but in addition to this, weighting corresponding to an elapsed time may be performed. In a case where weighting to the service life counter is changed based on an elapsed time, namely, an execution interval between wiping operations, it is sufficient to measure the elapsed time from the preceding wiping operation at the time of a wiping operation, and to add correction to the value previously added to the service life counter, based on the elapsed time.

Second Embodiment

Hereinafter, a second embodiment of the present invention will be described with reference to the drawings. Note that the basic configuration of the present embodiment is similar to that of the first embodiment, and thus only characteristic configurations will be described below.

Cleaning operations including a wiping operation (nozzle suction operation, nozzle pressurization operation, wiping operation) are frequently a series of operations including plural types of operations. Furthermore, these series of operations include a combination of plural types of operations, and the quantity of the ink adhering to the face surface 500 varies depending on the combinations. Accordingly, it is possible to know the service life of the blade cleaner 402 also by providing coefficients for each cleaning operation combined with plural types of operations and by performing weighting to the service life count value of the blade cleaner 402. Note that, since the method needs a smaller number of times of calculation than that in the first embodiment, reduction in load on CPU is expected.

Here, the cleaning operation unit is a sequential operation including a combination of a nozzle suction operation, a nozzle pressurization operation, a wiping operation, an ink ejection operation or a capping operation, and is an operation required for keeping the printing quality of a printing apparatus.

FIG. 10 is a table showing a breakdown of operations in each cleaning operation and coefficients corresponding to the cleaning operations. On the basis of the table, a coefficient is selected from a cleaning operation performed just before a wiping operation, and weighting in calculation of the service life is performed. For example, "cleaning strong" unit is an execution of a series of operations including a nozzle suction operation, an ink ejection operation, a wiping operation, and a capping operation.

Figure 11:
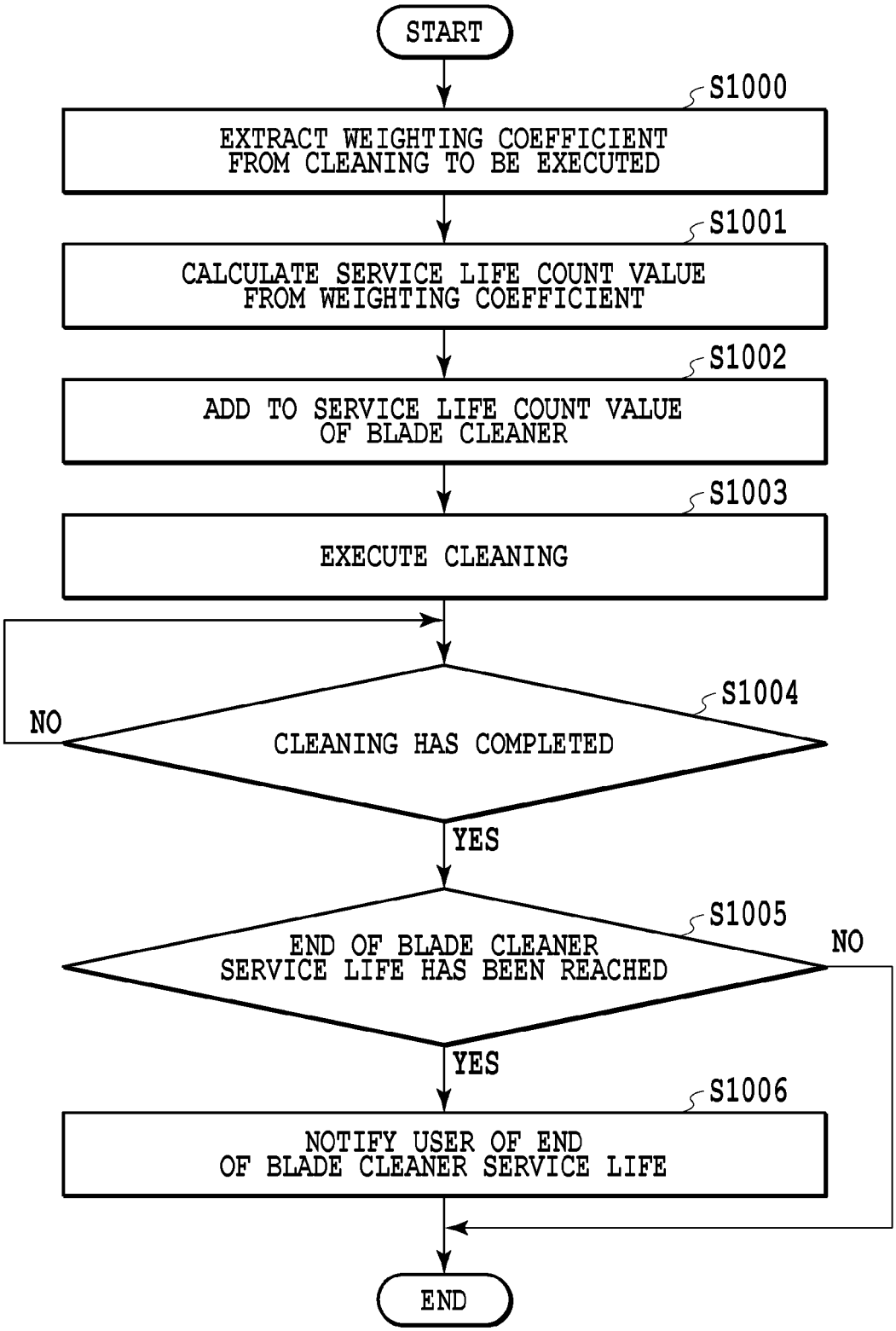
FIG. 11 is a flow chart showing processing in the wiping operation of the printing apparatus.

FIG. 11 is a flow chart showing processing in the wiping operation of the printing apparatus 100 of the present embodiment. Hereinafter, the wiping operation in the present embodiment will be described by the use of the flow chart. In a case where recovery unit 202 starts the wiping operation, CPU 301 extracts a weighting coefficient used for the service life count calculation from ROM 315 based on the cleaning operation to be executed, in Step S1000. Thereafter, CPU 301 calculates a count value to be added to the service life count value in Step S1001. Then, CPU 301 adds the count value of this time to the service life count value of the blade cleaner 402, in Step S1002. After that, recovery unit 202 executes the cleaning in Step S1003, cleaning completion is confirmed by CPU 301 in Step S1004, and then CPU 301 compares the service life count value previously added with the service life count threshold value of the blade cleaner 402 stored in the RAM 316 in Step S1005. In a case where the comparison result shows that the end of the service life has not yet been reached, the wiping operation is completed. In a case where the comparison result shows that the end of the service life of the blade cleaner has been reached, the processing proceeds to Step S1006 and CPU 301 notifies the user of the end of the service life by the error report or the like to be prompted to exchange the blade cleaner 402, and thus the wiping operation is completed.

As described above, coefficients are provided for each cleaning operation being a series of operations, and the service life of the recovery unit is determined by multiplication of the number of times the blade wipes the face surface by a coefficient that is different depending on the quantity of a liquid adhering to the face surface. Accordingly, it has become possible to realize a printing apparatus and a method for determining cleaning mechanism service life, capable of more accurately determining the service life of the cleaning mechanism.

Third Embodiment

Hereinafter, a third embodiment of the present invention will be described with reference to the drawings. Note that the basic configuration of the present embodiment is similar to that of the first embodiment, and thus only characteristic configurations will be described below.

Figure 12A:
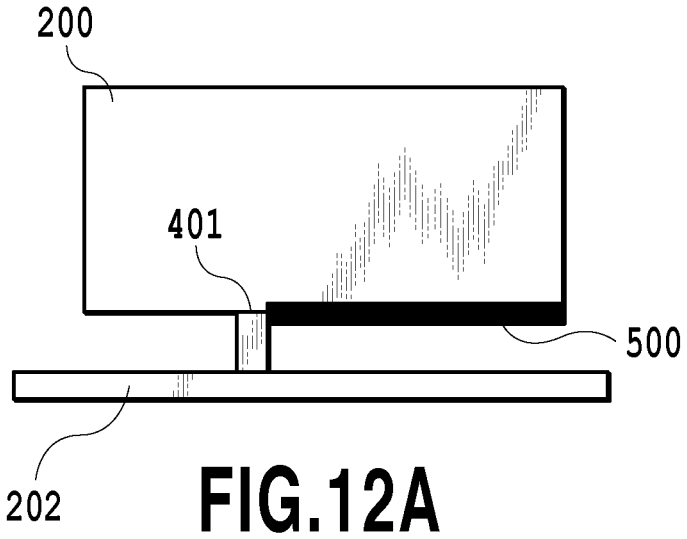
FIG. 12A is a diagram showing a case where an ink quantity adhering to the face surface is large.
Figure 12B:
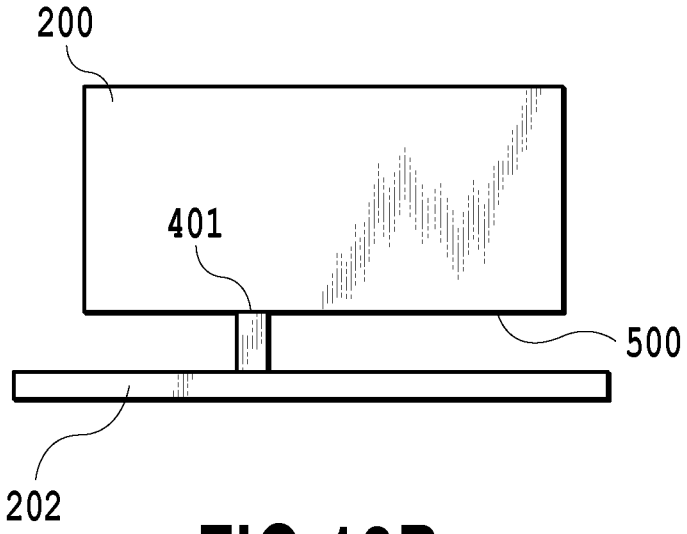
FIG. 12B is a diagram showing a case where an ink quantity adhering to the face surface is small.

FIGS. 12A and 12B are diagrams in a case where quantity of the ink adhering to the face surface 500 of the printing apparatus 100 is large or small. FIG. 12A shows a case where the quantity of adhering ink is large, and FIG. 12B shows a case where the quantity of adhering ink is small. In a case where the blade 401 performs wiping of the face surface 500, if the quantity of the ink adhering to the face surface is large as in FIG. 12A, the friction between the blade 401 and the face surface 500 is low. Therefore, the degree of consumption of the blade 401 is low. In contrast, if the quantity of the ink adhering to the face surface 500 is small as in FIG. 12B, the friction between the blade 401 and the face surface 500 is high. Therefore, the degree of consumption of the blade 401 is high. The quantity of the ink adhering to the face surface 500 varies depending on operations just before the wiping operation.

As described above, different quantities of inks adhering to the face surface 500 also cause different consumption degrees of the blade 401 at the time of wiping, and give different influences on the service life of the blade 401. Accordingly, if only the number of times of wiping operations is simply counted, an accurate service life of the blade 401 cannot be grasped. Consequently, in the present embodiment, coefficients are provided for each operation performed just before the wiping operation, and weighting is performed to the count value of the wiping operation for determining the service life of the blade 401.

Furthermore, an influence on the service life of the blade 401 varies also depending on an elapsed time from the completion of an operation performed just before the wiping operation. Namely, in a case where the elapsed time from the completion of an operation performed just before the wiping operation is short, the volatilization amount of a solvent component from the ink adhering to the face surface 500 is small, causing low friction and a low consumption degree of the blade 401. However, in a case where the elapsed time from the completion of an operation performed just before the wiping operation is long, volatilization of a solvent component from the ink adhering to the face surface 500 proceeds causing high viscosity and thus high friction resulting in a high consumption degree of the blade 401.

Consequently, in the present embodiment, in addition to coefficients for each operation performed just before the wiping operation, coefficients are provided for each elapsed time from the completion of an operation performed just before the wiping operation, and weighting is performed to the count value of the wiping operation. Accordingly, the service life of the recovery unit 202 is determined.

FIG. 13 is a table showing coefficients for each operation performed just before the wiping operation in the present embodiment. A case of the preceding operation being an ink ejection operation is set as a standard (1.0), and after a nozzle suction operation and a nozzle pressurization operation in which a quantity of the ink adhering to the face surface 500 is estimated to be large, the coefficient is set low and weighting to the service life counter of the blade cleaner 402 is performed. In contrast, after the wiping operation or capping operation in which a quantity of the ink adhering to the face surface 500 is estimated to be small, the coefficient is set high and weighting to the service life counter of the blade cleaner 402 is performed.

FIG. 14 is a table showing coefficients for each elapsed time from an operation performed just before the wiping operation in the present embodiment. The coefficient is made lower so that the shorter the elapsed time is, the lower the weighting becomes. This is intended in view of the fact that the shorter the elapsed time from adhesion of the ink to a face surface 5 is, the less the friction caused by increase in viscosity due to drying increases and the lower the consumption degree of the blade 401 caused by the wiping operation is.

Figure 15:
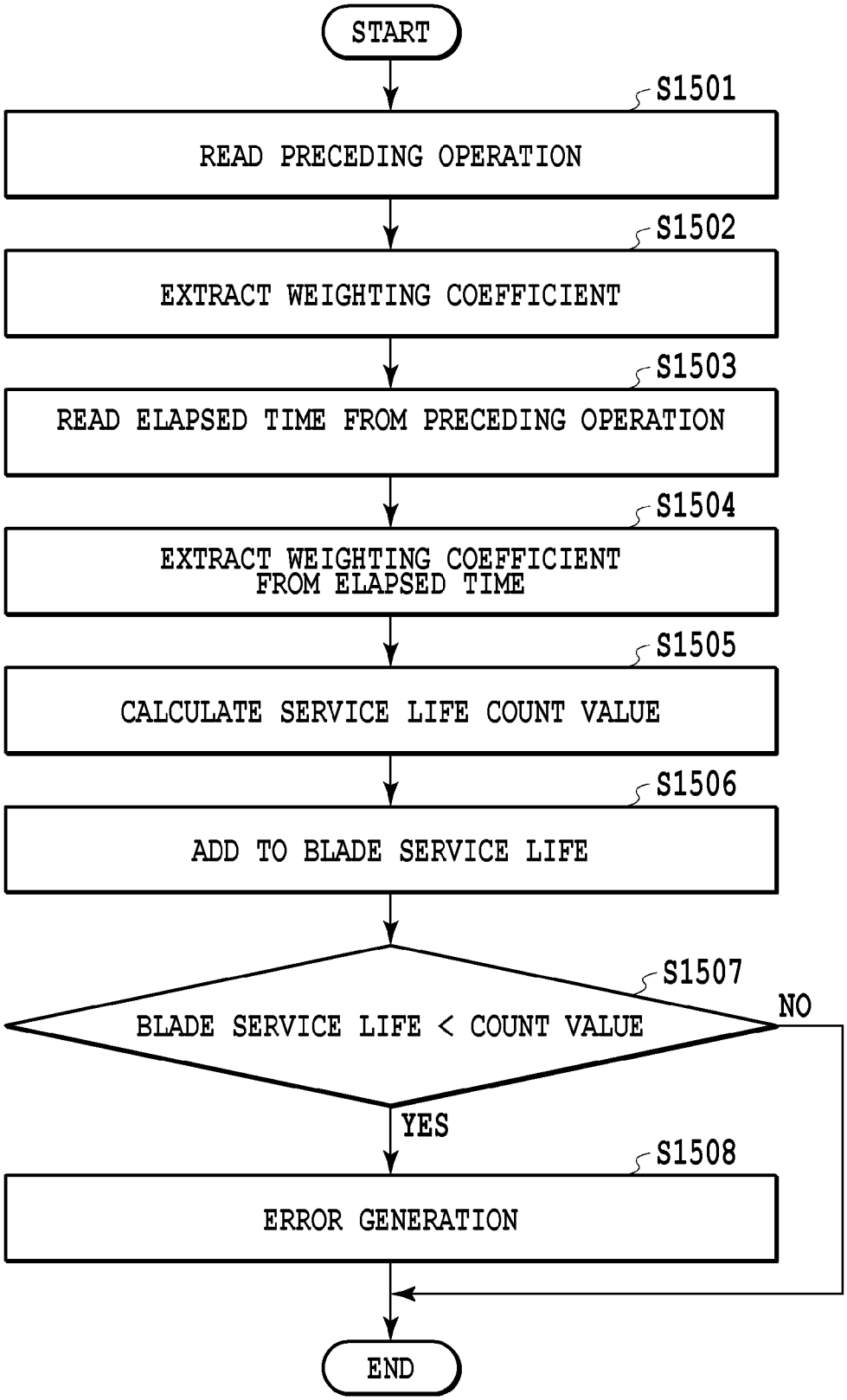
FIG. 15 is a flow chart showing processing in the wiping operation of the printing apparatus.

FIG. 15 is a flow chart showing processing in the wiping operation of the printing apparatus 100 of the present embodiment. Hereinafter, the wiping operation in the present embodiment will be described by the use of the flow chart. In a case where the recovery unit 202 starts a wiping operation, CPU 301 reads the preceding operation stored in the RAM 316 in Step S1501. Then, in Step S1502, CPU 301 extracts a weighting coefficient corresponding to the preceding operation read in Step S1501. In Step S1503, CPU 301 reads an elapsed time from the preceding operation, and extracts a weighting coefficient corresponding to the read elapsed time from ROM 315 in Step S1504. In Step S1505, CPU 301 calculates a count value to be added to the service life count value. After that, in Step S1506, CPU 301 adds the count value of this time based on the calculation result in Step S1505 to the service life count value of the blade 401 stored in the RAM 316. In addition, in Step S1507, CPU 301 compares the addition result with the service life count threshold value of the blade 401, and in a case where the addition result is within the service life count threshold value of the blade 401, the processing is completed. In a case where the addition result exceeds the service life count threshold value of the blade 401, the processing proceeds to Step S1508, CPU 301 notifies this fact to the user by error generation or the like. Then CPU 301 prompts the user to exchange the blade 401, and thus the processing is completed.

As described above, the service life of the recovery unit is determined by multiplication of the number of times the blade wipes the face surface by a coefficient that is different depending on the quantity of a liquid adhering to the face surface. Accordingly, it has become possible to realize a printing apparatus and a method for determining cleaning mechanism service life, capable of more accurately determining the service life of the cleaning mechanism.

Fourth Embodiment

Hereinafter, a fourth embodiment of the present invention will be described with reference to the drawings. Note that the basic configuration of the present embodiment is similar to that of the first embodiment, and thus only characteristic configurations will be described below.

There is a case where conditions of the face surface 500 before a wiping operation have approximately been fixed depending on types of recovery operations. For example, what corresponds to this is a wiping operation performed during manual recovery executed by a user. In such a case, a coefficient may be decided by reading at what timing the wiping operation is performed in the manual recovery, instead of the preceding operation.

FIG. 16 is a table showing an example of coefficients for consumption degrees for each number of times of wiping during the manual recovery in the present embodiment. The first wiping in a manual recovery operation is a wiping operation just after ejection, and thus the first wiping operation serves as the standard (1.0). Since the second wiping operation is executed just after the first wiping operation, the quantity of the ink adhering to the face surface 500 is small, and thus a coefficient is set large. In each of the third and fourth wiping operations, there is performed an operation in which the quantity of the ink adhering to the face surface 500 is large in a recovery control prior to the wiping operation in a series of processing (in the present embodiment, suction operation), and thus a coefficient is set small.

Figure 17:
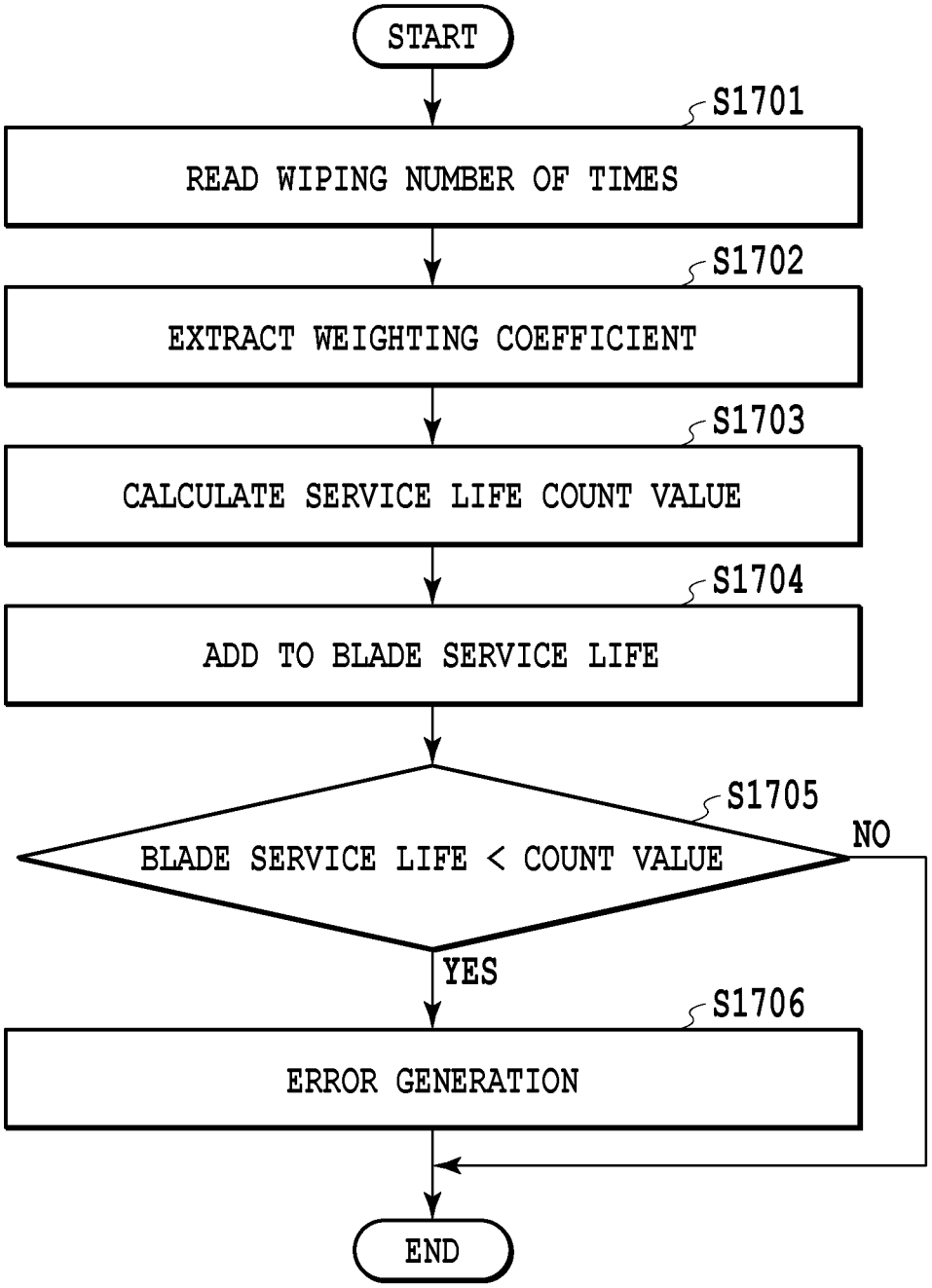
FIG. 17 is a flow chart showing processing in the wiping operation of the printing apparatus.

FIG. 17 is a flow chart showing processing in the wiping operation of the printing apparatus 100 of the present embodiment. Hereinafter, the wiping operation in the present embodiment will be described by the use of the flow chart. In a case where the recovery unit 202 starts a wiping operation, CPU 301 reads the number of times the wiping operation has been performed in a recovery sequence in Step S1701. Then, in Step S1702, CPU 301 extracts a weighting coefficient corresponding to a value indicating how many times the wiping operation has been performed, and in Step S1703, CPU 301 calculates a count number to be added to the service life count value. After that, in Step S1704, CPU 301 adds the count value of this time based on the calculation result to the service life count value of the blade 401 stored in the RAM 316. In Step S1705, CPU 301 compares the addition result with the threshold value of the blade service life, and in a case where the addition result is within the threshold value of the blade service life, the processing is completed as it is. In a case where the addition result exceeds the threshold value of the blade service life, the processing proceeds to Step S1706 where CPU 301 notifies this fact to the user by error generation or the like. Then CPU 301 prompts the user to exchange the blade 401, and thus the wiping operation is completed.

As described above, coefficients are provided for each cleaning operation being a previously decided series of operations, and the service life of the recovery unit is determined by multiplication of the number of times the blade wipes the face surface by a coefficient that is different depending on the quantity of a liquid adhering to the face surface. Accordingly, it has become possible to realize a printing apparatus and a method for determining cleaning mechanism service life, capable of more accurately determining the service life of the cleaning mechanism.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-092091 filed Apr. 28, 2016, which is hereby incorporated by reference wherein in its entirety.

What is claimed is:

1. A printing apparatus, comprising:

an ejection unit configured to eject liquid from ejection ports;

a blade configured to wipe an ejection port surface provided with the ejection ports; and a cleaner that performs cleaning of the blade;

an accumulative unit for storing accumulative information on an operation performed immediately before the blade wipes the ejection port surface from among a plurality of operations that can be performed immediately before the blade wipes the ejection port surface; and a notifying unit for notifying a service life of the cleaner based on an accumulative result of the accumulative unit.

2. The printing apparatus according to claim 1, wherein:

the notifying unit notifies a service life of the blade based on the accumulative result.

3. The printing apparatus according to claim 1, wherein:

the notifying unit changes an operation of the apparatus according to the accumulative result of the accumulative unit.

4. The printing apparatus according to claim 1, wherein:

the recovery unit includes a cap covering the surface of the ejection unit.

5. The printing apparatus according to claim 1, wherein:

an operation performed immediately before wiping the ejection port surface includes at least one of wiping of the ejection port surface by the blade, ejection of liquid from the ejection port, suction of liquid from the ejection port, and pressurization inside the ejection unit.

6. A method for notifying a service life, comprising:

a wiping step of wiping an ejection port surface provided with an ejection port ejecting liquid with a blade;

a cleaning step of cleaning the blade by a cleaner;

an accumulation step of storing accumulative information on an operation performed immediately before the blade wipes the ejection port surface from among a plurality of operations that can be performed immediately before the blade wipes the ejection port surface; and a notification step of notifying a service life of the cleaner based on an accumulative result of the accumulation step.

7. A printing apparatus, comprising:

an ejection unit configured to eject liquid from ejection ports;

a blade configured to wipe an ejection port surface provided with the ejection ports;

a cleaner that performs cleaning of the blade;

an accumulative unit for accumulating a result of performing weighting based on a type of operation performed immediately before the blade wipes the ejection port surface; and a notifying unit for notifying a service life of the cleaner based on an accumulative result of the accumulative unit.

8. The printing apparatus according to claim 7, wherein:

the accumulative unit performs weighting based on an interval from a preceding execution of cleaning of the blade by the cleaner.

9. The printing apparatus according to claim 7, wherein:

the accumulative unit performs weighting according to a series of a plurality of operations performed just before the blade wipes the surface.

10. The printing apparatus according to claim 7, wherein:

the notifying unit performs weighting by setting a coefficient and notifies a service life of the cleaner based on an accumulated value of values obtained by multiplication of a number of times the blade wipes the ejection port surface by the coefficient.

11. The printing apparatus according to claim 7, wherein:

an operation performed immediately before wiping the ejection port surface includes at least one of wiping of the ejection port surface by the blade, ejection of liquid from the ejection port, suction of liquid from the ejection port, and pressurization inside the ejection unit.

12. A method for notifying a service life, comprising:

a wiping step of wiping an ejection port surface provided with an ejection port for ejecting liquid with a blade;

a cleaning step of cleaning the blade by a cleaner;

an accumulation step of accumulating a result of performing weighting based on a type of operation performed immediately before the blade wipes the ejection port surface; and a notifying step of notifying the service life of the cleaner based on information accumulated in the accumulation step.

* * * * *